United States Patent [19]

Kuttruff et al.

[11] 3,986,330

[45] Oct. 19, 1976

[54] METHOD OF AND APPARATUS FOR TWISTING A YARN

[75] Inventors: Roland Kuttruff, Amriswil, Thurgau; Mauro Sbalzarini, Arbon, Thurgau, both of Switzerland

[73] Assignee: Evolution SA, Rorschach, Switzerland

[22] Filed: Apr. 8, 1975

[21] Appl. No.: 566,128

[30] Foreign Application Priority Data

Apr. 10, 1974 . Germany ..... 2417570

[52] U.S. Cl. ..... 57/94; 57/34 R; 57/156

[51] Int. Cl.[2] ..... D01H 1/30; D01H 1/26

[58] Field of Search ..... 57/92, 93, 156, 94, 57/95, 34 R, 98, 99; 318/6, 7

[56] References Cited

UNITED STATES PATENTS

| | | | |
|---|---|---|---|
| 2,735,257 | 2/1956 | Legard, Jr. et al. | 57/93 |
| 2,785,527 | 3/1957 | Lewellen et al. | 57/93 |
| 2,895,284 | 7/1959 | Drtina | 57/93 X |
| 3,120,731 | 2/1964 | Holschlag et al. | 57/94 |
| 3,325,985 | 6/1967 | Bucher | 57/93 |
| 3,443,373 | 5/1969 | Bryan, Jr. | 57/98 |
| 3,636,696 | 1/1972 | Howe et al. | 57/95 |
| 3,831,005 | 8/1974 | Schippers et al. | 57/93 X |

*Primary Examiner*—John Petrakes
*Attorney, Agent, or Firm*—Karl F. Ross; Herbert Dubno

[57] ABSTRACT

A yarn package is frictionally engaged by a roller and driven at a peripheral speed so as to pay off a filament that is wound on a spindle positively connected to the output shaft of a fixed-speed motor. This output shaft is also connected through a steplessly variable transmission to a roller-drive shaft that rotates the payoff roller and therefore determines the linear velocity of the filament. A pair of detectors are provided for generating respective outputs corresponding to the rotation speeds of the motor output shaft and the roller drive shaft. These two outputs are fed to a divider where they are combined into an actual-value signal that is compared with a set point so as to form a difference signal. A regulator operated by this deviation signal acts on the adjustment element of the steplessly variable transmission to maintain a constant ratio between the angular velocity of the two shafts so that uniform twist is imparted to the filament. In addition an indicator is provided on which the amount of twist imparted to the filament can be read out so that a set point generator can be adjusted to allow this twist to be altered even during operation of the device.

9 Claims, 1 Drawing Figure

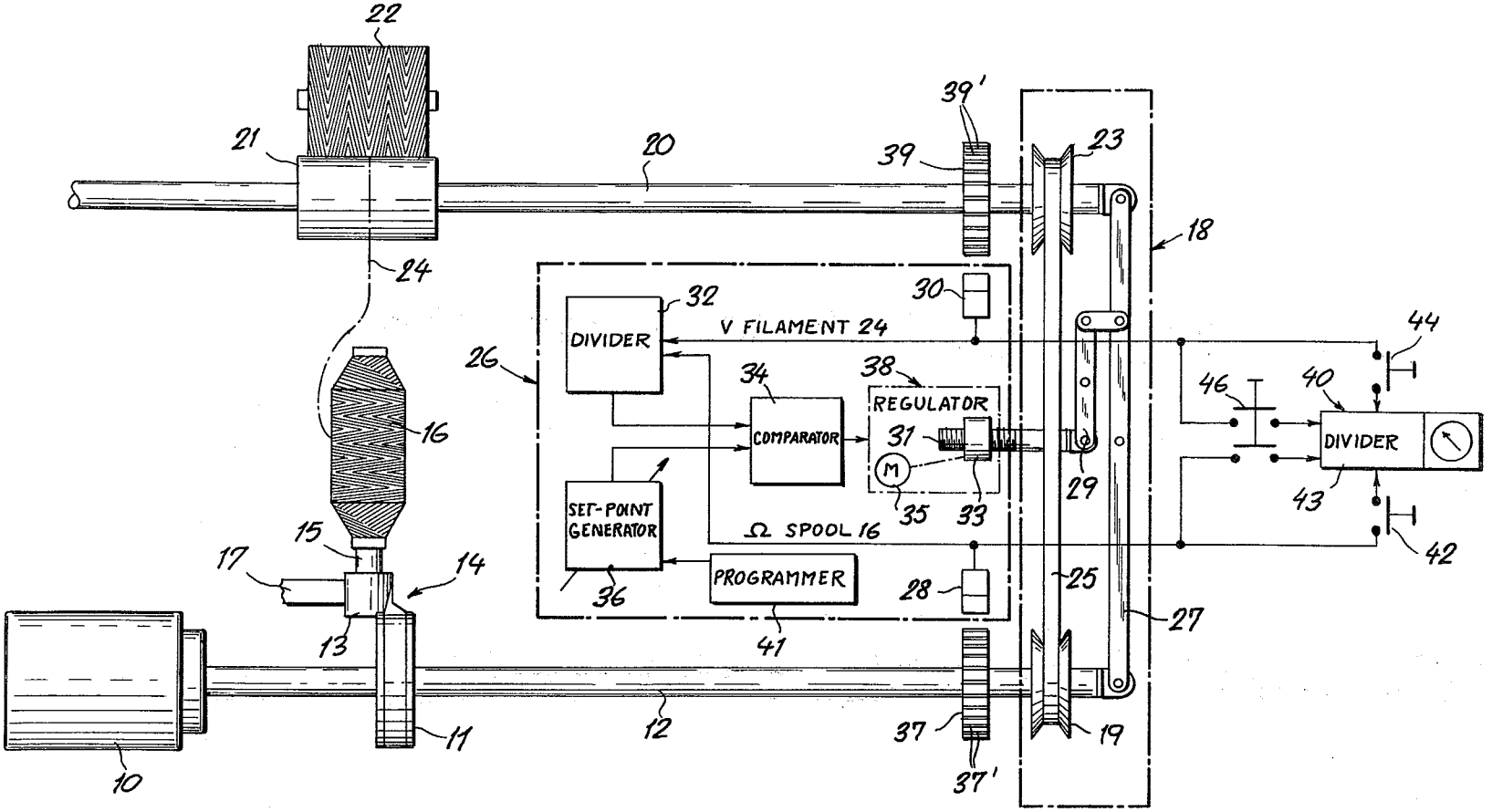
DIVIDER
REGULATOR
COMPARATOR
PROGRAMMER
DIVIDER
SET-POINT GENERATOR
V FILAMENT 24
Ω SPOOL 16
M

METHOD OF AND APPARATUS FOR TWISTING A YARN

FIELD OF THE INVENTION

The present invention relates to a method of and apparatus for twisting a filament. More particularly this invention concerns a system wherein a filament or yarn is drawn off a yarn package, twisted, and wound up on a spindle.

BACKGROUND OF THE INVENTION

A twisting apparatus usually comprises a frame on which a plurality of yarn packages and a plurality of spindles are mounted. The yarn is paid off the packages, twisted, and wound up on the spindles. The angular velocity of the spindle and the linear velocity of the yarn or filament being wound up on the spindle determine the amount of twist imparted to the yarn.

As a rule all of the spindles are driven by a common motor whose shaft has a pluraity of pulleys over which are spanned a plurality of flat belts engaging whorls on the spindles. Thus these spindles are driven at a constant speed. A transmission is connected between this shaft and the drive elements that determine the paying-off speed of the yarn from the yarn packages. These drive elements usually comprise driven rollers urged into peripheral contact with the outside of the yarn package and frictionally rotating this package so that the peripheral speed of the package and of the drive elements is equal to the linear velocity of the yarn.

Two types of transmission are used for interconnecting the drive shaft from the fixed-speed motor whose single drive shaft rotates all of the drive elements. These transmissions employ direct gearing so that the drive elements will rotate at a speed that is directly proportional to the motor output speed. In one type the gears are replaceable by gears of different sizes so that different throughput ratios can be obtained and, therefore, the amount of twist can similarly be varied by replacing these gears with gears of different sizes. It is also known to provide a much more complicated and expensive type of transmission which can be shifted by the operation of various clutches and levers so as to change the throughput ratio.

Both of these systems have the considerable disadvantage that only a limited number of throughput ratios can be obtained. The use of a steplessly variable transmission has been ruled out because the inevitable changes in throughput ratios in such transmission caused by thermal expansion, wear, and the like. Any change in throughput ratio changes the amount of twist imparted to the yarn, and, therefore, results in a finished product of nonuniform quality.

OBJECTS OF THE INVENTION

It is therefore an object of the present invention to provide an improved method of and apparatus for twisting a filament.

Another object is the provision of an improved method for operating a device of the above-described general type which overcomes the above-given disadvantages.

Yet another object is the provision of an improved yarn-twisting system wherein it is possible continuously to monitor the amount of twist being imparted to the filament and even to alter this amount of twist as the machine is running.

SUMMARY OF THE INVENTION

These objects are achieved according to the present invention in an apparatus of the above-described general type wherein a steplessly variable transmission is provided between the output shaft of the drive motor and the rotatable drive element which pays the yarn off the package and control means is provided which is connected to the drive element and to the output shaft as well as to the transmission for continuously adjusting the transmission and maintaining a predetermined ratio between the payoff speed of the yarn and the angular speed of the spindle.

According to another feature of this invention the control means is fully electronic and continuously monitors the payoff speed and the angular speed of the spindle and generates outputs corresponding thereto. These outputs are combined into a composite twist output which is compared with a set point for the generation of a difference signal which corresponds to the difference between the twist output and the set point. This difference signal is used to vary the throughput ratio of the transmission so as to maintain the speeds at a ratio established by the set point. A solenoid or servomotor is connected to the adjustment element of the steplessly variable transmission so as to displace this element until the composite twist output and set point are identical. In accordance with a further feature of this invention the output shaft of the motor and the shaft that drives the drive elements for the yarn packages are both provided with detector bodies having a plurality of angularly equispaced regions that can be detected electronically, preferably magnetically, by detectors connected to a divider or adder which forms the composite twist signal.

Means is provided according to another feature of this invention in the transmission for holding the transmission at a given setting in case the power to the unit fails so the last setting of the transmission will remain.

In accordance with yet another feature of this invention an indicator is provided which can be connected to read out the linear filament velocity, the angular spool velocity, or the amount of twist. Thus an operator need merely push a button to ascertain exactly how much twist is being imparted to the yarn. If too much or too little twist is present he need merely adjust the set point generator so as to establish the proper amount of twist.

Thus with the system according to the present invention the amount of twist imparted to the yarn is automaticaly and continously maintained at a predetermined level. Should the drive motor speed up or slow down the amount of twist imparted to the filament will remain constant. Similar adjustment can be made very simply, usually by rotating a simple potientometer that controls the oscillation frequency of a Schmitt trigger or the like while reading the extent of twist on a meter.

BRIEF DESCRIPTION OF THE DRAWING

The above and other objects, features, and advantages of the invention will become more readily apparent from the following description, reference being made to the accompanying drawing whose sole FIGURE is a schematic view of a system according to the present invention.

SPECIFIC DESCRIPTION

As shown in the drawing a drive motor 10 operating at a fixed speed has an output shaft 12 connected to a drive 14 consisting of a pulley 11, a pulley or whorl 13 mounted on a spindle 15, and a flat belt 17 interconnecting the pulleys 11 and 13. Several such pulleys 11 and pulleys 13 may be provided each with a respective belt 17, or one such belt 17 may span a plurality of such pulleys 11 and pulleys 13.

The shaft 12 is connected via a transmission 18 to a shaft 20 that drives a cylindrical roller 21 peripherally engaging a rotatable yarn package 22. A filament 24 from the package 22 is paid off as the roller 21 rotates and is picked up by the bobbin 16 on the spindle 15 so that this filament 24 is twisted and wound up.

The transmission 18 comprises a pair of variable pitch pulleys 19 and 23 interconnected by a belt 25 and each having one element axially displaceable by means of a two-arm lever 27 itself operated by a two-arm lever 29 connected to a threaded shaft 31 screwed into a nut 33 rotatable in either direction by means of a motor 35 of a regulator 38. The rotation of this nut 33 in one direction will increase the angular speed of the shaft 20 relative to that of the shaft 12 and rotation of this nut 33 in the opposite direction will cause the shaft 20 to rotate more slowly relative to the shaft 12. The pitch of the thread on screw 31 is very shallow so that the axial forces exerted by the belt 25 cannot alone serve to screw the rod 31 in the nut 33. Thus, absent actuation of the motor 35, the setting of the lever 27 established by the rod 31 will remain the same.

Control means 26 is provided having a pair of sensors 28 and 30 capable of detecting angularly equispaced ridges 37' and 39' on cylindrical wheels 37 and 39 carried on the respective shafts 12 and 20. These magnetic detectors 28 and 30 will therefore give pulse outputs respectively corresponding to the angular velocity of the spool 16 and the linear velocity v of the filament 24. These two outputs are received by a divider 32 that produces an actual-value or composite twist signal that is fed to a comparator 34. An adjustable set point generator 36 itself operated by a programmer 41 feeds a set point value to the comparator 34 which compares this set point signal with the actual value signal and feeds a deviation signal to the regulator 38. These circuit elements are described in chapter 9 of Pulse, Digital, and Switching Waveforms by Millman and Taub (McGraw Hill; 1965). If the deviation signal varies in one direction it indicates that the shaft 20 is turning too slowly relative to the shaft 12 and the regulator 38 operates the motor 35 so as to reset the transmission and makes the necessary correction to bring the actual-value signals and set point signals into equality. The action is similar if the shaft 20 is rotating too slowly.

The apparatus is further provided with an indicator 40, comprising a simple meter having several scales. This meter 40 can be connected via a momentary-contact button switch 44 to the output of the filament speed sensor 30 so as to read the payoff speed of the filament 24. It can also be connected via a momentary-contact push button switch 42 to the sensor 28 to read out the angular velocity of the spool 16. Finally a double-pole single-throw momentary-contact button switch is provided which connects this indicator and a divider 43 thereof to the two sensors 28 and 30 so as to read out the amount of twist being imparted to the yarn 24. This amount of twist is equal to the linear velocity v divided by the angular velocity.

Thus the operator can ascertain with a simple push of the button 46 the amount of twist being imparted to the filament 24 and, if the reading does not correspond to the desired value, can merely adjust the set-point generator 36 until the correct twist is obtained.

We claim:

1. An apparatus for paying a filament off a yarn package and twisting said filament and winding same up on a spindle, said apparatus comprising:

a drive motor having an output shaft positively connected to said spindle for rotatable driving same, so that the angular velocity of said spindle is directly proportional to the shaft rotation speed;

a rotatable drive element engaging said filament for paying same off said package at a speed directly proportional to the angular velocity of said element;

a steplessly variable transmission positively interconnecting said shaft and said drive element; and control means connected to said drive element and said output shaft and to said transmission for adjusting same and maintaining a predetermined ratio between said speeds, said control means including:

means adjacent said output shaft for generating an output corresponding to the angular speed thereof;

means associated with said drive element for generating an output corresponding to the pay-off speed;

means for combining said outputs into a composite twist signal representing number of twist turns per unit length of said filament; and means connected to said transmission for varying the throughput ratio between said shaft and said drive element in accordance with said twist signal.

2. The apparatus defined in claim 1 wherein said control means further comprises means for generating a set point signal corresponding to a desired twist of said filament, and means between said means for generating said set point signal, said means for combining said outputs, and said means connected to said transmission for combining said set point signal and said composite twist signal into a deviation signal and for feeding same to said means connected to said transmission.

3. The apparatus defined in claim 2 wherein said means adjacent said output shaft includes a disk carried on said shaft and having a plurality of angularly equispaced detectable portions and means for detecting said portions.

4. The apparatus defined in claim 1, further comprising indicator means for displaying said composite twist signal.

5. The apparatus defined in claim 1, further comprising indicator means and switch means connected between said indicator means and said means for generating the pay-off output and said means for generating the angular-speed output for displaying said outputs.

6. A method of operating an apparatus for twisting a filament and having a drive element for paying the filament off a yarn package at a pay-off speed and driven through a transmission by a drive motor rotating at an angular speed a spindle on which said filament is wound up, said method comprising the steps of:

continuously monitoring said pay-off speed and generating an output corresponding thereto, continuously monitoring said angular speed and generating an output corresponding thereto, combining said outputs into a composite twist output, comparing said twist output with a set point and generating a deviation signal corresponding to the difference therebetween, and varying the throughput ratio of said transmission in accordance with said deviation signal to maintain said speeds at a ratio established by said set point.

7. The method defined in claim 6 wherein said spindle is rotated at a fixed constant speed so that variation of said throughput ratio varies said pay-off speed.

8. The method defined in claim 7, further comprising the step of continuously generating said set point.

9. The method defined in claim 8 wherein said outputs and said signal are all electrical.

* * * * *